US009929487B2

(12) United States Patent
Chen et al.

(10) Patent No.: US 9,929,487 B2
(45) Date of Patent: Mar. 27, 2018

(54) CONNECTOR ASSEMBLY AND RECEPTOR CONNECTOR AND CABLE END CONNECTOR THEREOF

(71) Applicants: Tarng Yu Enterprise co., ltd., New Taipei (TW); DELL Products L.P., Round Rock, TX (US)

(72) Inventors: Tsung-Chi Chen, New Taipei (TW); Mu-Jung Huang, New Taipei (TW); Chai-Fa Chang, Round Rock, TX (US); Shao-Szum Ho, Round Rock, TX (US)

(73) Assignees: TARNG YU ENTERPRISE CO., LTD., New Taipei (TW); DELL PRODUCTS L.P., Round Rock, TX (US)

( * ) Notice: Subject to any disclaimer, the term of this patent is extended or adjusted under 35 U.S.C. 154(b) by 0 days.

(21) Appl. No.: 15/410,733

(22) Filed: Jan. 19, 2017

(65) Prior Publication Data

US 2017/0331210 A1 Nov. 16, 2017

(30) Foreign Application Priority Data

May 10, 2016 (TW) ..... 105206764 A

(51) Int. Cl.

| | |
|---|---|
| ***H01R 13/629*** | (2006.01) |
| ***H01R 13/627*** | (2006.01) |
| ***H01R 12/77*** | (2011.01) |
| *H01R 13/645* | (2006.01) |

(52) U.S. Cl.

CPC ..... *H01R 12/77* (2013.01); *H01R 13/629* (2013.01); *H01R 13/6273* (2013.01); *H01R 13/6456* (2013.01)

(58) Field of Classification Search

CPC .. H01R 12/77; H01R 13/629; H01R 13/6273; H01R 13/6456

USPC ..... 439/350, 353, 358, 680, 59, 79, 76.1, 439/629, 566

See application file for complete search history.

(56) References Cited

U.S. PATENT DOCUMENTS

| | | | | |
|---|---|---|---|---|
| 3,399,374 A * | 8/1968 | Pauza | ..... | H01R 13/514 174/138 F |
| 4,851,725 A * | 7/1989 | Keck | ..... | H01R 13/74 144/248.5 |
| 4,900,261 A * | 2/1990 | Gentry | ..... | H01R 13/6273 439/353 |
| 5,011,425 A * | 4/1991 | Van Zanten | ..... | H01R 13/6275 439/353 |

(Continued)

*Primary Examiner* — Renee Luebke
*Assistant Examiner* — Paul Baillargeon
(74) *Attorney, Agent, or Firm* — Chun-Ming Shih

(57) ABSTRACT

A connector assembly includes a receptor connector and a cable end connector. The receptor connector has a receptor terminal set, a receptor connector body, a slot set and a guide slot set. The cable end connector has a cable end terminal set, a cable end connector body, a block set and a guide block set. The invention allows the cable end connector body to be connected with the receptor connector body by means of the guide slot set and the guide block set, and also allows the receptor terminal set to be plugged with the cable end terminal set by means of the slot set and the block set. Thereby, the receptor connector and the cable end connector of the invention can be easily connected.

12 Claims, 5 Drawing Sheets

(56) References Cited

U.S. PATENT DOCUMENTS

| | | | | |
|---|---|---|---|---|
| 5,779,495 | A * | 7/1998 | Dechelette | H01R 13/6275 439/352 |
| 6,830,472 | B1 * | 12/2004 | Wu | H01R 13/6275 439/352 |
| 7,563,112 | B2 * | 7/2009 | Honda | H01R 43/0256 439/79 |
| 8,033,861 | B2 * | 10/2011 | Zhu | H01R 12/7029 439/567 |

* cited by examiner

CONNECTOR ASSEMBLY AND RECEPTOR CONNECTOR AND CABLE END CONNECTOR THEREOF

CROSS-REFERENCE TO RELATED APPLICATIONS

This application claims the priority of Republic of China Patent Application No. 105206764 filed on May 10, 2016, in the State Intellectual Property Office of the R.O.C., the disclosure of which is incorporated herein by reference.

BACKGROUND OF THE INVENTION

Field of the Invention

The invention relates to connector assemblies and receptor connectors and cable end connectors thereof, and more particularly, to a connector assembly having a guiding structure, and a receptor connector and a cable end connector of the connector assembly.

Descriptions of the Related Art

Most electronic devices are built in with receptor connectors and cable end connectors, for allowing transmission of electronic signals through connecting between the receptor connectors and the cable end connectors. However, satisfactory connection between small receptor and cable end connectors is not easily achieved.

Therefore, the invention is to provide structurally improvement in receptor connectors and cable end connectors in order to solve the above problem for conventional small receptor and cable end connectors.

SUMMARY OF THE INVENTION

In view of the above problem of the prior art, the invention provides a connector assembly for use in electrical connection with a circuit board. The connector assembly includes a receptor connector and a cable end connector. The receptor connector includes a receptor connector body, a slot set, a guide slot set and a receptor terminal set. The receptor connector body includes a guiding opening and a sliding opening, wherein the guiding opening is formed on a side of the receptor connector body, and the sliding opening is formed at bottom of the receptor connector body. The slot set includes a left slot and a right slot. The receptor connector body further includes a left extension block formed on a side thereof for being connected with the cable end connector, wherein the left extension block is extended into the left slot and divides the left slot into a first left part and a second left part communicating with the first left part. The receptor connector body further includes a right extension block formed on the side thereof for being connected with the cable end connector, wherein the right extension block is extended into the right slot and divides the right slot into a first right part and a second right part communicating with the first right part. The guide slot set includes a left guide slot, a middle guide slot and a right guide slot. The receptor terminal set includes at least a left receptor terminal and at least a right receptor terminal. The cable end connector includes a cable end connector body, a block set, a guide block set and a cable end terminal set. The block set includes a first left block, a second left block, a first right block and a second right block, wherein a distance between the first left block and the second left block is substantially equal to a width of the left extension block, and a distance between the first right block and the second right block is substantially equal to a width of the right extension block. The guide block set includes a left guide block, a middle guide block and a right guide block. The cable end terminal set includes at least a left cable end terminal and at least a right cable end terminal. The left guide block, the middle guide block and the right guide block are respectively inserted in the left guide slot, the middle guide slot and the right guide slot, so as to guide a connecting end of the cable end connector body into the guiding opening of the receptor connector body, wherein the cable end connector body slides on the circuit board through the sliding opening until the first left block, the second left block, the first right block and the second right block are respectively engaged with the first left part, the second left part, the first right part and the second right part, such that the left cable end terminal and the right cable end terminal are plugged respectively along a predetermined route with the left receptor terminal and the right receptor terminal so as to connect the cable end connector with the receptor connector.

Compared to the prior art, the invention allows the connecting end of the cable end connector body to successfully enter the receptor connector body by means of the guide slot set and the guide block set, and also allows the receptor terminal set to be plugged with the cable end terminal set by means of the slot set and the block set. Thereby, the receptor connector and the cable end connector of the invention can be easily connected.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
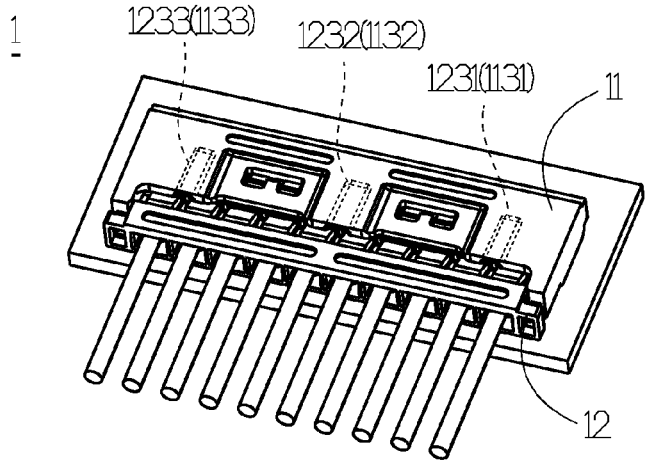
FIG. 1 is a schematic view showing a use status of an electric connector assembly of the invention.
Figure 2:
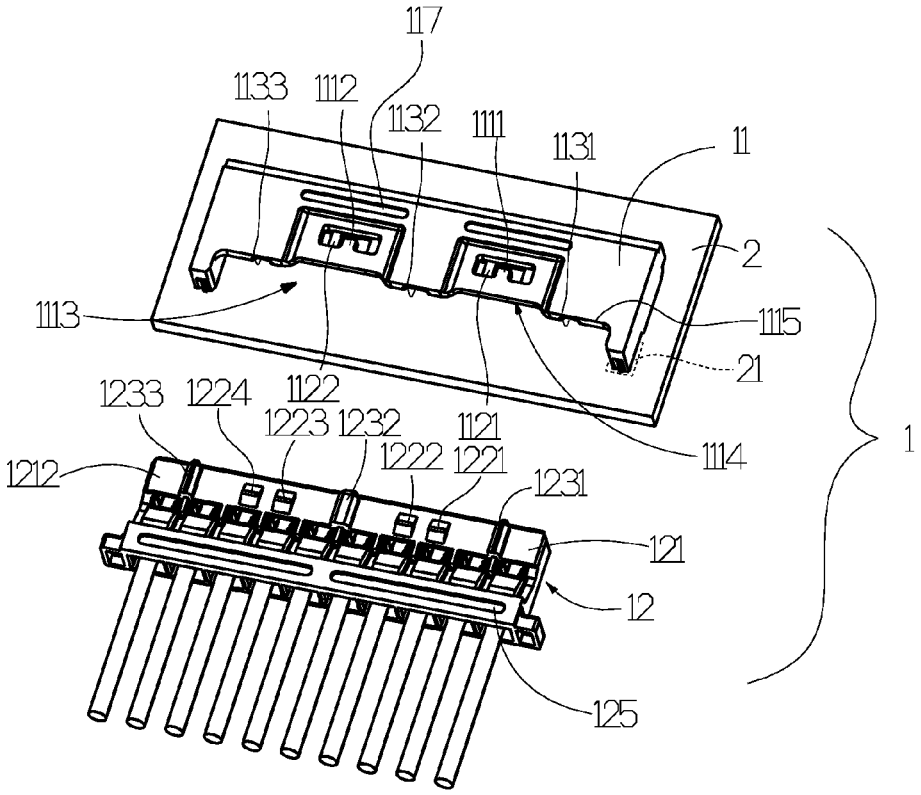
FIG. 2 is a schematic view showing disassembly of the electric connector assembly of FIG. 1.
Figure 3:
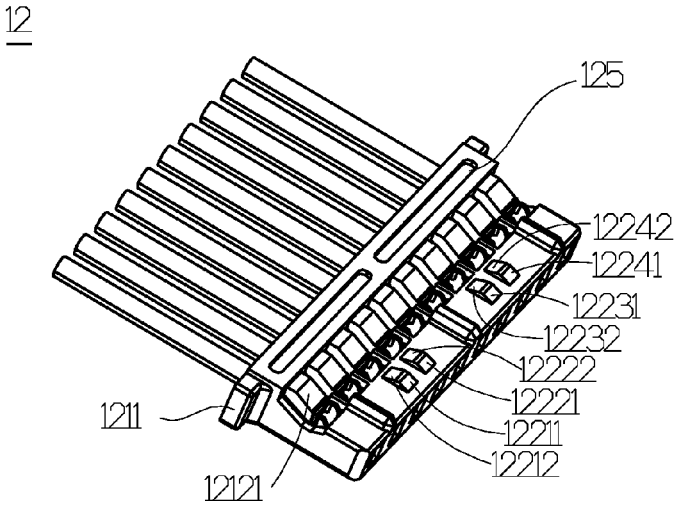
FIG. 3 is a schematic view of a cable end connector of the invention.
Figure 4:
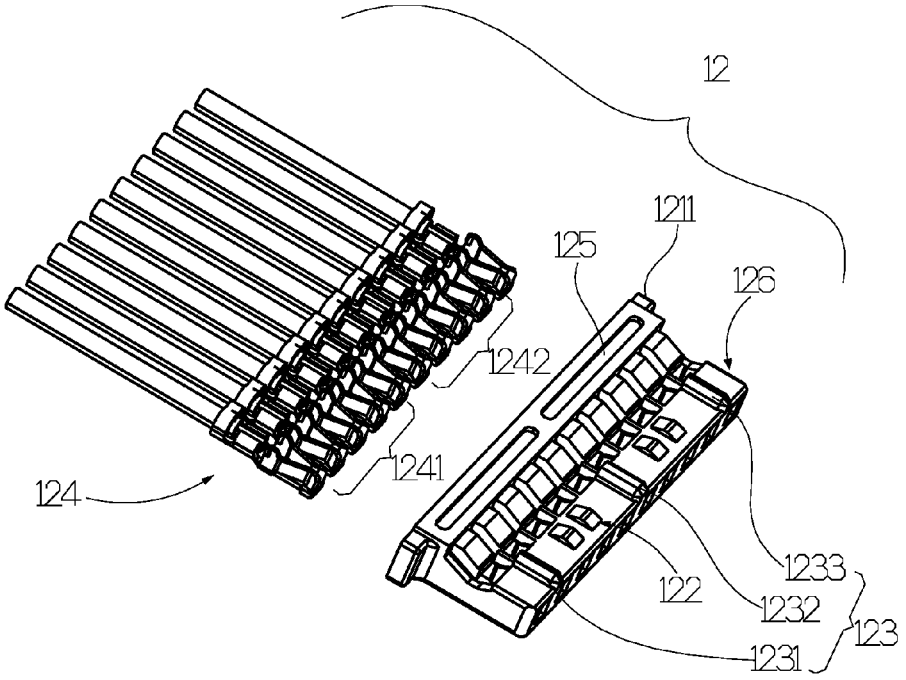
FIG. 4 is a schematic view showing disassembly of the cable end connector of the invention.
Figure 5:
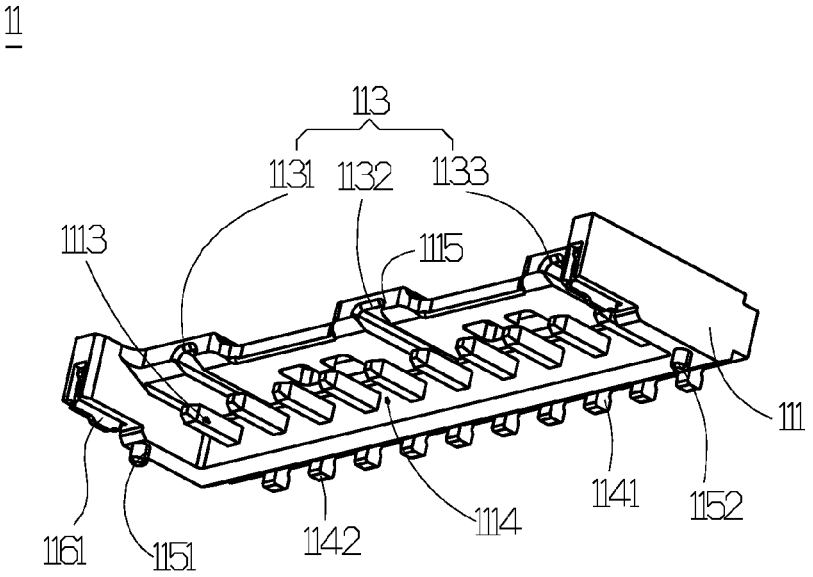
FIG. 5 is a schematic view of a receptor connector of the invention.
Figure 6:
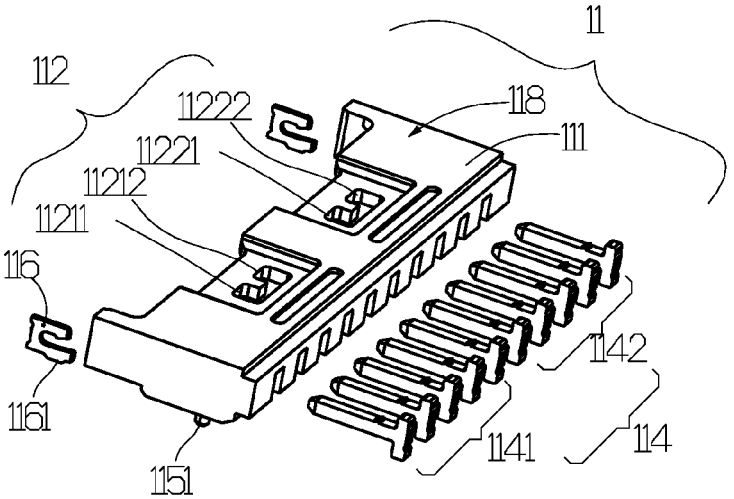
FIG. 6 is a schematic view showing disassembly of the receptor connector of the invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

The invention provides a structurally novel connector assembly for use in electrical connection with a circuit board. As shown in FIGS. 1 to 9, the connector assembly 1 of the invention includes a receptor connector 11 and a cable end connector 12. The receptor connector 11 is mounted on the circuit board 2, for being connected with the cable end connector 12. The receptor connector 11 is formed with a receptor connector case 118 for being matched with the cable end connector 12. The cable end connector 12 is formed with a cable end connector case 126 for being matched with the receptor connector 11.

In the invention, the receptor connector 11 includes a receptor connector body 111, a slot set 112, a guide slot set 113 and a receptor terminal set 114. The receptor connector body 111, the slot set 112 and the guide slot set 113 together form the receptor connector case 118 for being matched with the cable end connector 12. The receptor connector body 111 has a guiding opening 1113 and a sliding opening 1114. The guiding opening 1113 is formed on a side of the receptor connector body 111. The sliding opening 1114 is formed at bottom of the receptor connector body 111. The slot set 112 is provided on the receptor connector body 111, for being engaged with a cable end connector body 121 of the cable end connector 12. The slot set 112 has at least a left slot 1121 and at least a right slot 1122. The receptor connector body 111 has a left extension block 1111 formed on a side thereof where the cable end connector 12 can be connected. The left extension block 1111 is extended into the left slot 1121, and divides the left slot 1121 into a first left part 11211 and a second left part 11212, wherein the first and second left parts 11211, 11212 communicate with each other and together form a U shape. The receptor connector body 111 further has a right extension block 1112 formed on the side thereof where the cable end connector 12 can be connected. The right extension block 1112 is extended into the right slot 1122, and divides the right slot 1122 into a first right part 11221 and a second right part 11222, wherein the first and second right parts 11221, 11222 communicate with each other and together form a U shape.

The receptor connector body 111 may selectively formed on a surface thereof with at least a receptor recognition mark 117, such as a groove, which serves as a structural feature for recognizing the receptor connector 11.

In the invention, the receptor connector 11 is further formed with a positioning post set 115 for positioning the receptor connector body 111 on the circuit board 2. The positioning post set 115 may selectively include a first positioning post 1151 and a second positioning post 1152, which are formed at different locations on a positioning surface of the receptor connector body 111 for being mounted to the circuit board 2. Each of the first and second positioning posts 1151, 1152 is located in a manner having different distances from different edges of the receptor connector body 111. This provides a foolproof effect to allow the receptor connector body 111 to be correctly positioned on the circuit board 2.

The guide slot set 113 is formed in an opening of the receptor connector body 111 for being connected with the cable end connector 12. The guide slot set 113 includes a left guide slot 1131, a middle guide slot 1132 and a right guide slot 1133, for guiding a connecting end 1212 of the cable end connector body 121 into the guiding opening 1113 of the receptor connector body 111. The receptor connector body 111 has a thickened part around the guide slot set 113. The thickened part of the receptor connector body 111 is formed with outwardly extended flanges 1115, and increases strength of the receptor connector body 111 around the guide slot set 113. Provision of the flanges 1115 makes the guide slot set 113 extended outwardly, such that the connecting end 1212 of the cable end connector body 121 may be more easily guided into the guiding opening 1113 of the receptor connector body 111. The receptor terminal set 114 includes at least a left receptor terminal 1141 and at least a right receptor terminal 1142. Selectively, the left receptor terminal 1141 and the right receptor terminal 1142 may have a T shape, and the receptor terminal set 114 may have a plurality of left receptor terminals 1141 and a plurality of right receptor terminals 1142, wherein the left guide slot 1131 is located on the right of the most left one of the left receptor terminals 1141, the right guide slot 1133 is located on the left of the rightest one of the right receptor terminals 1142, and the middle guide slot 1132 is located between the left and right guide slots 1131, 1133. This arrangement prevents the left, middle and right guide slots 1131, 1132, 1133 from being too close to end portions of the receptor connector body 111 so as not to structurally affect these end portions which, if not having sufficient strength, might be damaged during a process of connecting the cable end connector 12 and the receptor connector 11.

The above end portions of the receptor connector body 111 in the invention may further be mounted with at least a supporting element 116 for being welded to the circuit board 2 and providing more structural strength. The supporting element 116 includes at least a weld leg 1161 for being bonded to a welding area 21 of the circuit board 2. Selectively, the welding area 21 is not located at edges of the circuit board 2, and the weld leg 1161 is right above the welding area 21.

In the invention, the cable end connector 12 includes the cable end connector 121, a block set 122, a guide block set 123 and a cable end terminal set 124. The cable end connector 121, the block set 122 and the guide block set 123 together form the cable end connector case 126 for being matched with the receptor connector 11. The block set 122 is provided on the cable end connector 121 and used for being engaged with the receptor connector body 111. The block set 122 includes a first left block 1221, a second left block 1222, a first right block 1223 and a second right block 1224. The distance between the first left block 1221 and the second left block 1222 is substantially equal to the width of the left extension block 1111, such that the first left block 1221 and the second left block 1222 may correspondingly enter the first left part 11211 and the second left part 11212 so as to engage the block set 122 with the receptor connector body 111. It should be noted that, the left extension block 1111 may abut against sides of the first and second left blocks 1221, 1222 that are inserted in the first and second left parts 11211, 11212, thereby assuring the engagement between the first and second left blocks 1221, 1222 and the receptor connector body 111.

The distance between the first right block 1223 and the second right block 1224 is substantially equal to the width of the right extension block 1112, such that the first right block 1223 and the second right block 1224 may correspondingly enter the first right part 11221 and the second right part 11222 so as to engage the block set 122 with the receptor connector body 111. It should be noted that, the right extension block 1112 may abut against sides of the first and second right blocks 1223, 1224 that are inserted in the first and second right parts 11221, 11222, thereby assuring the engagement between the first and second right blocks 1223, 1224 and the receptor connector body 111.

Figure 7:
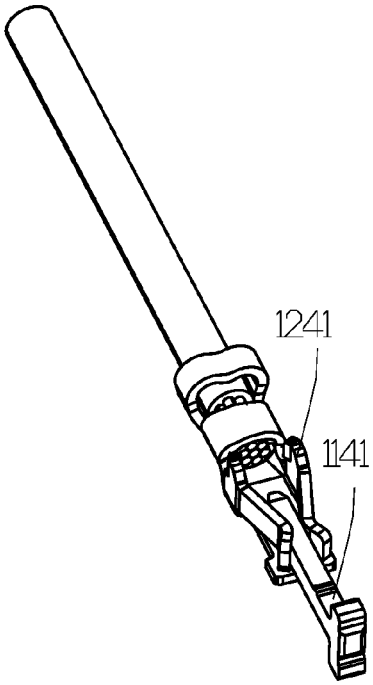
FIG. 7 is a schematic view showing connection between a cable end terminal and a receptor terminal of the electric connector assembly of the invention.
Figure 8:
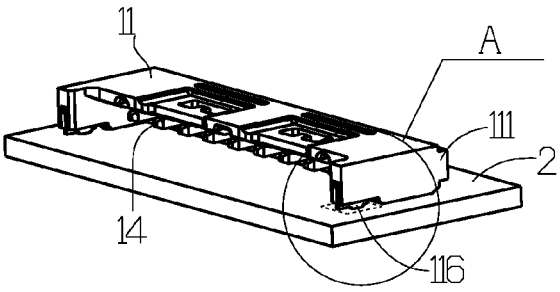
FIG. 8 is a schematic view showing a use status of the receptor terminal of the invention.
Figure 9:
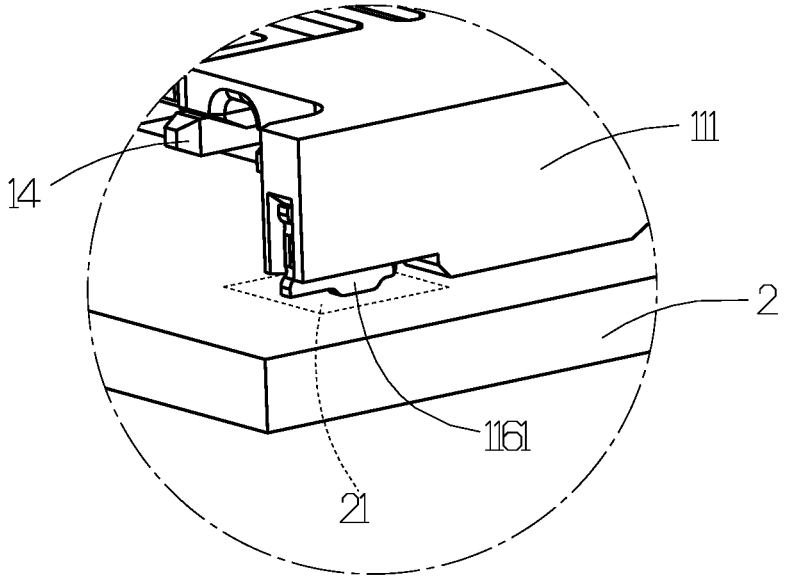
FIG. 9 is an enlarged view of area A in FIG. 8.

The guide block set 123 includes a left guide block 1231, a middle guide block 1232 and a right guide block 1233. The cable end terminal set 124 includes at least a left cable end terminal 1241 and at least a right cable end terminal 1242. The left guide block 1231, the middle guide block 1232 and the right guide block 1233 may correspondingly enter the left guide slot 1131, the middle guide slot 1132 and the right guide slot 1133 of the guide slot set 113, so as to guide the connecting end 1212 of the cable end connector body 121 into the guiding opening 1113 of the receptor connector body 111. The cable end connector body 121 is allowed to slide on the circuit board 2 through the sliding opening 1114 until the first left block 1221, the second left block 1222, the first right block 1223 and the second right block 1224 respectively enter and engage the first left part 11211, the second left part 11212, the first right part 11221 and the second right part 11222. Thereby, the left cable end terminal 1241 and the right cable end terminal 1242 can be plugged respectively along a predetermined route with the left receptor terminal 1141 and the right receptor terminal 1142, and connection between the cable end connector 12 and the receptor connector 11 is achieved. FIG. 7 shows the status of the left receptor terminal 1141 being inserted in the left cable end terminal 1241.

Selectively, the guide block set 123 and the block set 122 in the invention are provided at the connecting end 1212 of the cable end connector body 121, and the connecting end 1212 has a slope 12121 for allowing the connecting end 1212 to enter the guiding opening 1113 without interfering with the cable end connector body 121.

Selectively, the first left block 1221, the second left block 1222, the first right block 1223 and the second right block 1224 in the invention may correspondingly have engaging guide slops 12211, 12221, 12231, 12241 and disengaging guide slops 12212, 12222, 12232, 12242. The engaging guide slops 12211, 12221, 12231, 12241 can respectively guide the first left block 1221, the second left block 1222, the first right block 1223 and the second right block 1224 to be engaged with the first left part 11211, the second left part 11212, the first right part 11221 and the second right part 11222. The disengaging guide slops 12212, 12222, 12232, 12242 can respectively guide the first left block 1221, the second left block 1222, the first right block 1223 and the second right block 1224 to be disengaged from the first left part 11211, the second left part 11212, the first right part 11221 and the second right part 11222.

Selectively, the left guide block 1231, the middle guide block 1232 and the right guide block 1233 are each extended from the cable end connector body 121 towards the receptor connector body 111 for a length larger than a length of the first left block 1221, the second left block 1222, the first right block 1223 and the second right block 1224 each extended from the cable end connector body 121 towards the receptor connector body 111. This is to assure the connecting end 1212 of the cable end connector body 121 to be guided into the receptor connector body 111.

Selectively, the left guide block 1231, the middle guide block 1232 and the right guide block 1233 are correspondingly formed with tapered ends having guiding pyramid parts 12311, 12321, 12331. These guiding pyramid parts 12311, 12321, 12331 are used to respectively guide the left guide block 1231, the middle guide block 1232 and the right guide block 1233 into the left guide slot 1131, the middle guide slot 1132 and the right guide slot 1133, so as to make sure the connecting end 1212 of the cable end connector body 121 to enter the guiding opening 1113 of the receptor connector body 111.

In the invention, the cable end connector body 121 may further be formed with at least a cable end recognition mark 125 on a surface thereof, which serves as a structural feature for recognizing the cable end connector 12. The cable end connector body 121 may also be formed with an operating part 1211 at an edge thereof where a force may be applied to allow the connecting end 1212 of the cable end connector body 121 to enter the guiding opening 1113 of the receptor connector body 111. Selectively, the operating part 1211 is shaped as a block structure for the sake of easy force application.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. A connector assembly for electrical connection with a circuit board, including:

a receptor connector; and a cable end connector; wherein, the receptor connector includes a receptor connector body, a slot set, a guide slot set and a receptor terminal set; the receptor connector body includes a guiding opening and a sliding opening, wherein the guiding opening is formed on a side of the receptor connector body, and the sliding opening is formed at bottom of the receptor connector body; the slot set includes a left slot and a right slot; the receptor connector body further includes a left extension block formed on a side thereof for being connected with the cable end connector, wherein the left extension block is extended into the left slot and divides the left slot into a first left part and a second left part communicating with the first left part; the receptor connector body further includes a right extension block formed on the side thereof for being connected with the cable end connector, wherein the right extension block is extended into the right slot and divides the right slot into a first right part and a second right part communicating with the first right part; the guide slot set includes a left guide slot, a middle guide slot and a right guide slot; the receptor terminal set includes at least a left receptor terminal and at least a right receptor terminal; and the cable end connector includes a cable end connector body, a block set, a guide block set and a cable end terminal set; the block set includes a first left block, a second left block, a first right block and a second right block, wherein a distance between the first left block and the second left block is substantially equal to a width of the left extension block, and a distance between the first right block and the second right block is substantially equal to a width of the right extension block; the guide block set includes a left guide block, a middle guide block and a right guide block; the cable end terminal set includes at least a left cable end terminal and at least a right cable end terminal; wherein, the left guide block, the middle guide block and the right guide block are respectively inserted in the left guide slot, the middle guide slot and the right guide slot, so as to guide a connecting end of the cable end connector body into the guiding opening of the receptor connector body, wherein the cable end connector body slides on the circuit board through the sliding opening until the first left block, the second left block, the first right block and the second right block are respectively engaged with the first left part, the second left part, the first right part and the second right part, such that the left cable end terminal and the right cable end terminal are plugged respectively along a predetermined route with the left receptor terminal and the right receptor terminal so as to butt the cable end connector with the receptor connector;

wherein the left guide block, the middle guide block and the right guide block are extended from the cable end connector body towards the receptor connector body for a length larger than a length of the first left block, the second left block, the first right block and the second right block extended from the cable end connector body towards the receptor connector body.

2. A receptor connector provided on a circuit board, for being connected with a cable end connector, wherein the cable end connector includes a cable end connector body, a block set, a guide block set and a cable end terminal set; the block set includes a first left block, a second left block, a first right block and a second right block; the guide block set includes a left guide block, a middle guide block and a right guide block; the cable end terminal set includes at least a left cable end terminal and at least a right cable end terminal; wherein the receptor connector includes:

a slot set including a left slot and a right slot;

a receptor connector body including a guiding opening, a sliding opening, a left extension block and a right extension block; wherein the guiding opening is formed on a side of the receptor connector body; the sliding opening is formed at bottom of the receptor connector body; the left extension block is formed on a side of the receptor connector body for being connected with the cable end connector, and is extended into the left slot and divides the left slot into a first left part and a second left part communicating with the first left part; the right extension block is formed on the side of the receptor connector body for being connected with the cable end connector, and is extended into the right slot and divides the right bayonet slot into a first right part and a second right part communicating with the first right part; a width of the left extension block is substantially equal to a distance between the first left block and the second left block; a width of the right extension block is substantially equal to a distance between the first right block and the second right block;

a guide slot set including a left guide slot, a middle guide slot and a right guide slot; and a receptor terminal set including at least a left receptor terminal and at least a right receptor terminal; wherein, the left guide block, the middle guide block and the right guide block are respectively inserted in the left guide slot, the middle guide slot and the right guide slot, so as to guide a connecting end of the cable end connector body into the guiding opening of the receptor connector body, wherein the cable end connector body slides on the circuit board through the sliding opening until the first left block, the second left block, the first right block and the second right block are respectively engaged with the first left part, the second left part, the first right part and the second right part, such that the left cable end terminal and the right cable end terminal are plugged respectively along a predetermined route with the left receptor terminal and the right receptor terminal so as to connect the cable end connector with the receptor connector;

wherein the first right part and the second right part communicating with each other together form a U shape; and the first left part and the second left part communicating with each other together form a U shape.

3. The receptor connector according to claim 2, further comprising a positioning post set for positioning the receptor connector body on the circuit board, wherein the positioning post set includes a first positioning post and a second positioning post, which are formed at different locations on the receptor connector body and are each located in a manner having different distances from different edges of the receptor connector body.

4. The receptor connector according to claim 2, wherein the receptor terminal set includes a plurality of left receptor terminals and a plurality of right receptor terminals, wherein the left guide slot is located on the right of the most left one of the left receptor terminals, the right guide slot is located on the left of the rightest one of the right receptor terminals, and the middle guide slot is located between the left and right guide slots.

5. The receptor connector according to claim 2, further comprising at least a supporting element mounted on an end portion of the receptor connector body, wherein the supporting element includes at least a weld leg for being bonded to a welding area of the circuit board, wherein the welding area is free of being located at edges of the circuit board, and the weld leg is located above the welding area.

6. The receptor connector according to claim 2, wherein the receptor connector body has a thickened part around the guide slot set, and the thickened part is formed with an outwardly extended flange.

7. The receptor connector according to claim 2, wherein the left receptor terminal and at least a right receptor terminal have a T shape.

8. A cable end connector for being connected with a receptor connector, the receptor connector including a receptor connector body, a slot set, a guide slot set and a receptor terminal set, wherein the receptor connector body includes a guiding opening and a sliding opening, the guiding opening being formed on a side of the receptor connector body, and the sliding opening being formed at bottom of the receptor connector body; the slot set includes a left slot and a right slot; the receptor connector body further includes a left extension block formed on a side thereof for being connected with the cable end connector, wherein the left extension block is extended into the left slot and divides the left slot into a first left part and a second left part communicating with the first left part; the receptor connector body further includes a right extension block formed on the side thereof for being connected with the cable end connector, wherein the right extension block is extended into the right slot and divides the right slot into a first right part and a second right part communicating with the first right part; the guide slot set includes a left guide slot, a middle guide slot and a right guide slot; the receptor terminal set includes at least a left receptor terminal and at least a right receptor terminal; wherein the cable end connector includes:

a cable end connector body;

a block set including a first left block, a second left block, a first right block and a second right block, wherein a distance between the first left block and the second left block is substantially equal to a width of the left extension block, and a distance between the first right block and the second right block is substantially equal to a width of the right extension block;

a guide block set including a left guide block, a middle guide block and a right guide block; and a cable end terminal set including at least a left cable end terminal and at least a right cable end terminal; wherein, the left guide block, the middle guide block and the right guide block are respectively inserted in the left guide slot, the middle guide slot and the right guide slot, so as to guide a connecting end of the cable end connector body into the guiding opening of the receptor connector body, wherein the cable end connector body slides on the circuit board through the sliding opening until the first left block, the second left block, the first right block and the second right block are respectively engaged with the first left part, the second left part, the first right part and the second right part, such that the left cable end terminal and the right cable end terminal are plugged respectively along a predetermined route with the left receptor terminal and the right receptor terminal so as to connect the cable end connector with the receptor connector;

wherein the left guide block, the middle guide block and the right guide block are extended from the cable end connector body towards the receptor connector body for a length larger than a length of the first left block, the second left block, the first right block and the second right block extended from the cable end connector body towards the receptor connector body.

9. The cable end connector according to claim 8, wherein the guide block set and the block set are provided at the connecting end of the cable end connector body, and the connecting end has a slope for allowing the connecting end to enter the guiding opening without interfering with the receptor connector body.

10. The cable end connector according to claim 8, wherein the cable end connector body is further formed with an operating part at an edge thereof where a force is applied to allow the connecting end of the cable end connector body to enter the guiding opening of the receptor connector body.

11. The cable end connector according to claim 8, wherein the first left block, the second left block, the first right block and the second right block have engaging guide slopes and disengaging guide slopes, wherein the engaging guide slopes respectively guide the first left block, the second left block, the first right block and the second right block to be engaged with the first left part, the second left part, the first right part and the second right part, and wherein the disengaging guide slopes respectively guide the first left block, the second left block, the first right block and the second right block to be disengaged from the first left part, the second left part, the first right part and the second right part.

12. The cable end connector according to claim 8, wherein the left guide block, the middle guide block and the right guide block are formed with tapered ends having guiding pyramid parts, and the guiding pyramid parts are used to respectively guide the left guide block, the middle guide block and the right guide block into the left guide slot, the middle guide slot and the right guide slot.

* * * * *